United States Patent [19]

Iannucci

[11] Patent Number: 4,462,552

[45] Date of Patent: Jul. 31, 1984

[54] YARN BOBBIN WINDING MACHINE

[75] Inventor: Vincent A. Iannucci, West Lawn, Pa.

[73] Assignee: Rockwell International Corporation, Pittsburgh, Pa.

[21] Appl. No.: 518,979

[22] Filed: Aug. 1, 1983

Related U.S. Application Data

[63] Continuation-in-part of Ser. No. 379,524, May 19, 1982, abandoned.

[51] Int. Cl.[3] ..... B65H 54/02; B65H 54/28; B65H 57/28

[52] U.S. Cl. ..... 242/42; 242/18 R; 242/43 R; 242/43.1; 242/157 R; 242/158.3

[58] Field of Search ..... 242/42, 18 R, 35.5 R, 242/43 R, 157 R, 158.3, 43.1

[56] References Cited

U.S. PATENT DOCUMENTS

| | | | |
|---|---|---|---|
| 1,219,958 | 3/1917 | Kron | 242/42 |
| 1,966,507 | 7/1934 | Langstreth | 242/42 |
| 2,185,309 | 1/1940 | Pierce | 242/158.3 |
| 2,519,461 | 8/1950 | Hanson | 242/158.3 |
| 2,945,636 | 7/1960 | Lenk | 242/42 |
| 3,198,447 | 8/1965 | Hambach | 242/43 R |
| 3,414,205 | 12/1968 | Aschwanden | 242/43 R |
| 4,087,056 | 5/1978 | Wilding | 242/43 R |
| 4,154,410 | 5/1979 | Haehnel et al. | 242/42 |

*Primary Examiner*—Stanley N. Gilreath

[57] ABSTRACT

A yarn winding machine for performing open winding of multiple ends of yarn onto a bobbin wherein all yarn ends are to be substantially the same length and under the same tension. The machine includes a frame on which bobbin and bobbin receiving means are disposed; traversing means including a yarn guide roll and a yarn guide beak that is elongated so that it can contact the yarn package; and yarn guiding means spaced from the yarn guide roll a distance such that the enclosed lash angle of the multiple yarn ends between the guiding means and the guide roll is not more than 20°.

3 Claims, 13 Drawing Figures

20
21
18
86
26
25
17
16
14
Z
Y
13
12
11

170
20
70
71
61
60
30
31
39
38
54
29

85
84
83
81
81
86
17
80
82
27
5
27
17
86
80
16
28
18
5
25
25

YARN BOBBIN WINDING MACHINE

BACKGROUND OF THE INVENTION

This application is a continuation-in-part of copending application Ser. No. 379,524 which was filed on May 19, 1982, by the same inventors as this application and is assigned to the same assignee, now abandoned.

This invention relates to machines for the high speed open winding of a plurality of yarn ends simultaneously.

In winding a plurality, for example, a group of eight ends of yarns on a bobbin, it is vital that each yarn end be under the same tension and have the same tension and have the same length as the other ends of yarn in the group.

It is also desirable when winding multiple ends of yarn onto a bobbin or similar package to use a winding construction other than a parallel wind. An open wind (also known as a cross-wind) clearly defines that all ends are being unwound in the same manner in which they were wound consequently avoiding unequal lengths, tanglement, etc.

In order to accomplish the both objectives, certain known arts had to be combined.

The tensioning and feeding of the multiple ends of yarn is accomplished by godet rolls, which separate and control each yarn end as though they were one. These godet rolls have been strategically placed so that the lash angle created by the feed point and traverse guide is minimal. In this case, the total lash angle is less than 20°. This minimal angle has minimal effect on length change to the adjacent multiple yarn ends.

In the normally used parallel wind, the traverse guide can be placed at a point beyond the radius of the bobbin flange; however, in open winding a guide in this position would cause the yarn to lag the traverse resulting in a poorly wound package, which would influence take-up tensions and affect uniform godet roll feeding and consequently unequal yarn end lengths. It has been found that the multiple ends of yarn have to be guided up to the point of lay on the package, therefore, we have incorporated an elongated guide which operates between the bobbin flanges. In operating a guide between the bobbin flanges, traverse length became important due to changes in yarn denier and in number of ends being wound. Therefore, a mechanism for adjusting the length of traverse was employed.

Another problem not encountered with parallel winding, but present when open or cross-winding is performed, is the formation of what is known in the textile industry as ribboning. A gainer mechanism is also incorporated into this winder to prevent this undesirable winding condition.

SUMMARY OF THE INVENTION

A principal object of the present invention is to provide an improved machine for the open winding of yarn ends onto a flanged bobbin.

More specifically, an important object of the invention is to provide a yarn bobbin winding machine having a special relationship between the various cooperating functional operating parts so that the yarn ends being fed onto the bobbin are all of essentially the same length.

The foregoing objects of the invention are achieved by the provision of an elongated yarn guide beak mounted on and carried by an adjusting rod which guide beak extends all the way to the package so that there is no opportunity for the yarn ends to stray from their intended location on the package.

Also necessary to the success is the positioning of the means which guides the yarn toward a yarn guide roll carried on the traverse mechanism relative to the yarn guide roll. Specifically, it has been found that bobbins can be successfully loaded with and of equal length only if the last angle of the length of yarn between the guide means and the guide roll does not exceed 20°. Lash angle is the angle enclosed by the yarn ends at the guide means when the yarn ends on the bobbin are at each bobbin extremity. This machine also includes a mechanism for adjusting the length of traverse, specifically, a cam follower, riding in the fixed upwardly inclined track, causes a bell crank to pivot continuously in a counterclockwise direction about its pivot point. This causes the upper end of the bell crank to move continuously to the left, thereby pushing a slidable adjustment rod continuously to the left relative to a slide bracket. This moves the guide beak continuously to the left relative to the slide bracket which is moving continuously to the right. A similar result is obtained when the slide bracket traverses from right to left. The cam follower, moving along the fixed downwardly inclined cam track, causes the bell crank to move continuously about its pivot point in the clockwise direction, thereby pushing the adjustment rod continuously to the right relative to the slide bracket which is moving continuously from right to left.

While the slope of the cam track is fixed for any particularly winding operation, the angle of inclination or slope of the cam track is adjustable so as to accommodate for different winding conditions and resulting yarn displacement behavior.

DETAILED DESCRIPTION OF THE PREFERRED EMBODIMENTS

Figures 1, 2, 3:
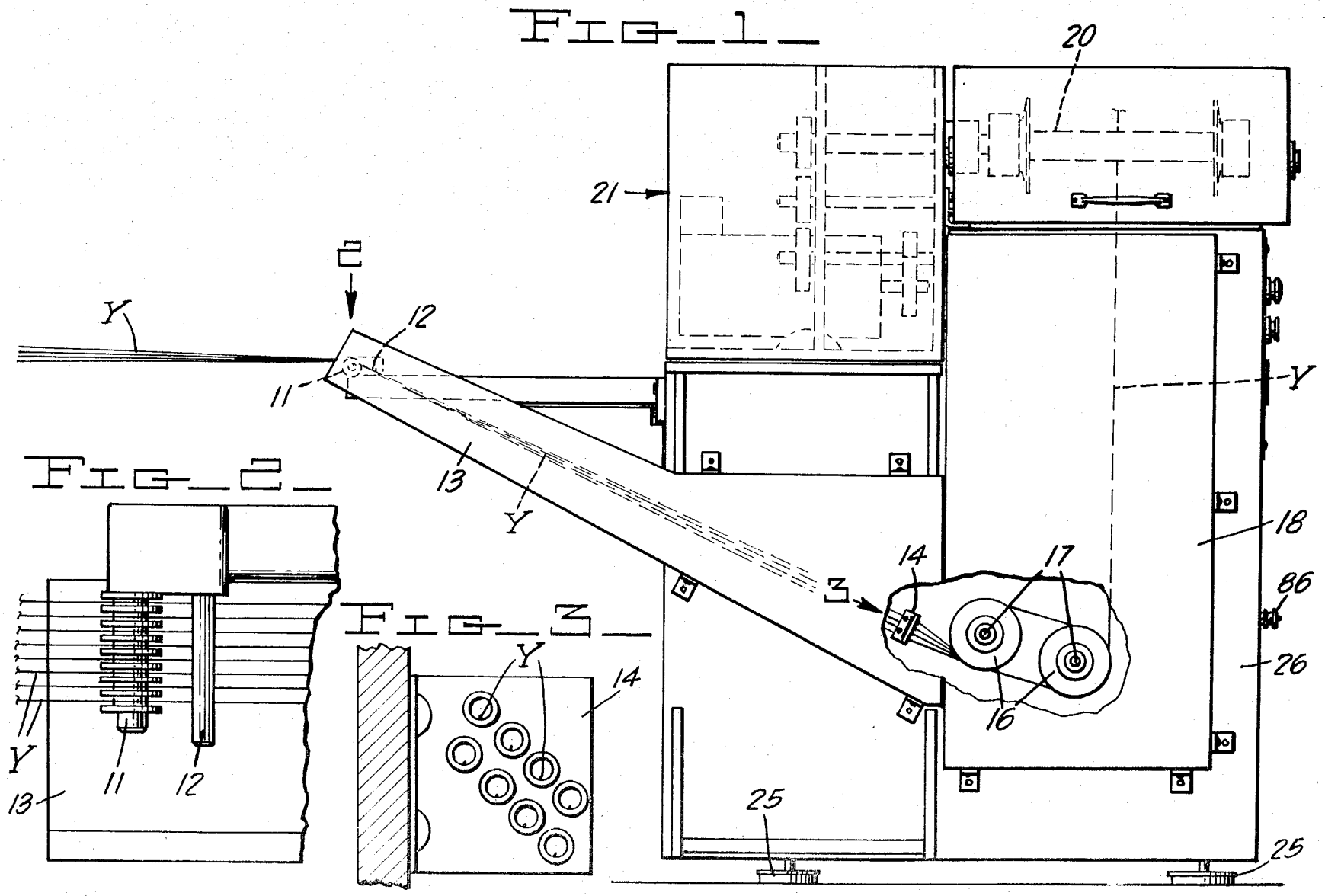
FIG. 1 is a front elevational view of a yarn bobbin winding machine incorporating the present invention.
FIG. 2 is a detailed view of a yarn separating device as seen looking in the direction of the arrow at point 2 of FIG. 1.
FIG. 3 is a detailed view of a porcelain eyelet separator, as seen looking in the direction of the arrow at point 3 in FIG. 1.

In FIG. 1, a plurality of ends of yarn Y which for discussion will be assumed to eight ends but which could be some other number, are pulled from a drum or other source of supply (not shown) through a yarn-end separator 11 and under a yarn support pin 12, as shown in detail in FIG. 2. The eight ends of yarn Y are pulled in a downwardly inclined direction, protected by a cover or guide 13, and, as shown in FIG. 3, pass through a porcelain eyelet separator 14 mounted in a bracket. The yarn ends then pass under, around, and over yarn guide means, which is shown here as a pair of Godet wheels 16 mounted for rotation on skewed shafts 17. The Godet wheels are under adjustable tension by a mechanism shown in FIG. 5, which will be described later. The eight yarn ends then travel upwardly, protected by a cover or guard 18, to a yarn bobbin 20 which is driven rotationally by a drive mechanism assembly identified generally by reference number 21. The bobbin drive assembly 21 includes a drive motor which may preferably be a variable speed DC motor. The drive mechanism, and the manner in which it drives the yarn bobbin 20, is well known and will not be described in detail.

Figures 4, 5:
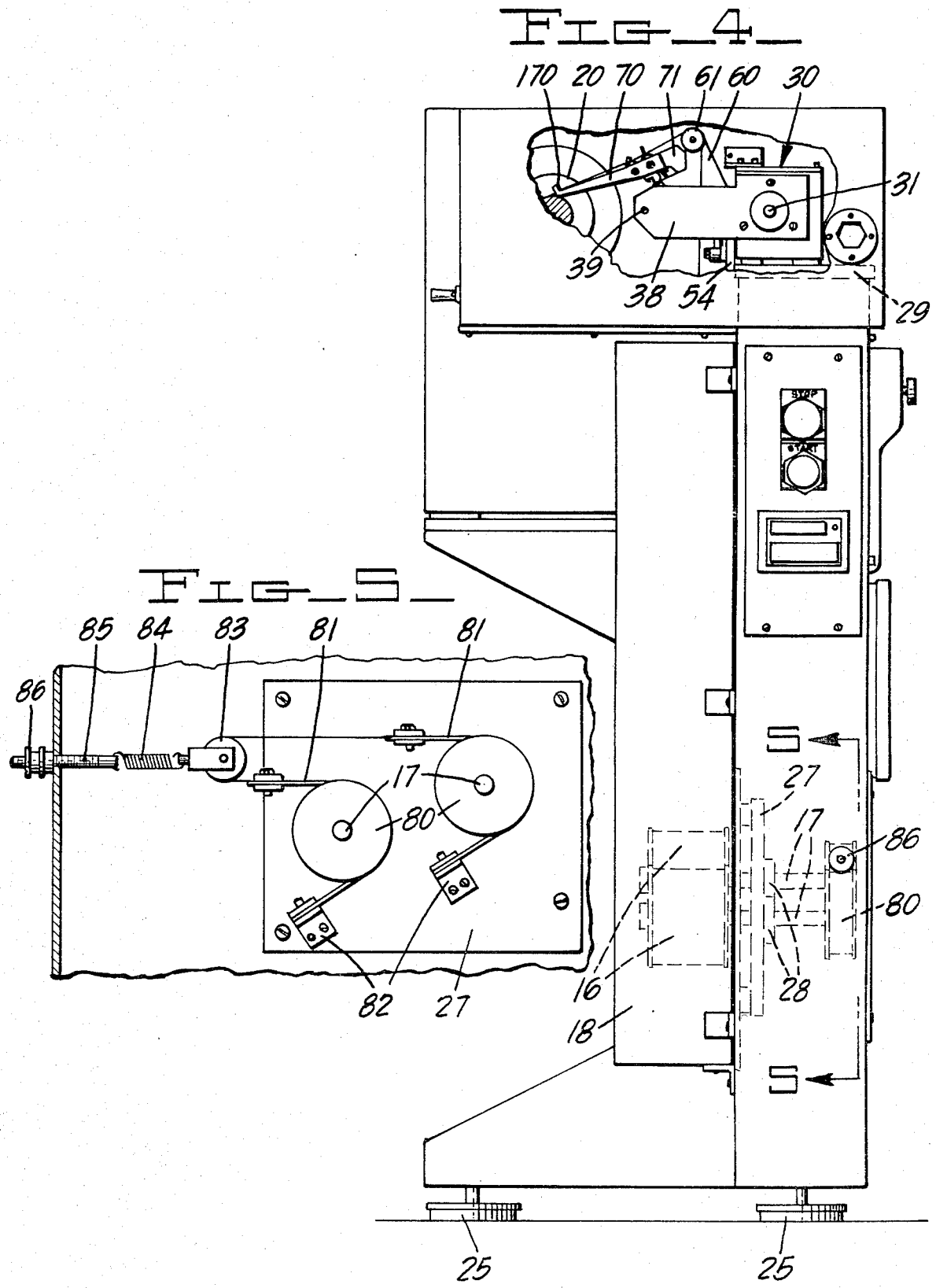
FIG. 4 is a side elevational view of the winding machine of FIG. 1.
FIG. 5 is a detailed view of the tensioning device for the Godet wheels, as seen looking along the line 5—5 of FIG. 4.

FIG. 4 is a side elevational view of the machine which is shown to be supported on adjustable feet 25. FIG. 4 shows in dotted line the pair of Godet wheels 16 about which the yarn ends are drawn and the shafts 17 on which the Godet wheels 16 are supported. As indicated, the shafts 17 are mounted in bearing 28 in a plate 27 secured to frame 26. The function of the Godet rolls is to keep the individual yarn ends separate from each other and to provide the desired tension to the yarn ends.

Supported at the upper end of frame 26 on a base plate 29 is a housing 30 for the main traverse assembly. Each of the elements of the main traverse assembly shown in FIG. 4 are shown and described in greater detail in other figures of the drawing, which will be discussed later. So far as FIG. 4 is concerned, it will merely be said that the yarn traverse assembly includes a yarn bobbin 20, a beak guide 70, a beak guide holder 71, a yarn guide roller 61, a bracket 60, a traverse cam shaft 31, a traverse cam 32, and a cam track 54 plate.

FIG. 5, which is a view along the line 5—5 of FIG. 4 looking in the direction of the arrows, shows the means for adjusting the tension on the Godet wheels 16. As there shown, mounted on each Godet shaft 17 is a flat pulley 80 around which a brake band 81, which may be of fabric, or rawhide, or other suitable material, is drawn. The brake band is connected at its two ends to a pair of brackets 82 and is tensioned by means comprising a roller 83, a spring 84, an adjustment stud 85, and an adjustment knob 86.

FIG. 4 of the drawings clearly shows that the lower yarn guide means, Godet rolls 16, are located an appreciable distance from the yarn guide roll 61 which is carried by the yarn traverse mechanism. The distance between Godet rolls 16 and guide wheel 61 is vital to the successful operation of this high speed open winder. It has been found that for successful operation, that the lash angle or angle enclosed by the length of yarn between Godet rolls 16 and guide roll 61 must not exceed 20°. This angle is one defined by the yarn when the traverse mechanism is located at its extreme positions along the bobbin 20. If the enclosed angle exceeds 20°, then the yarn lengths become unequal and the package of yarn is unacceptable for use.

Figure 9:
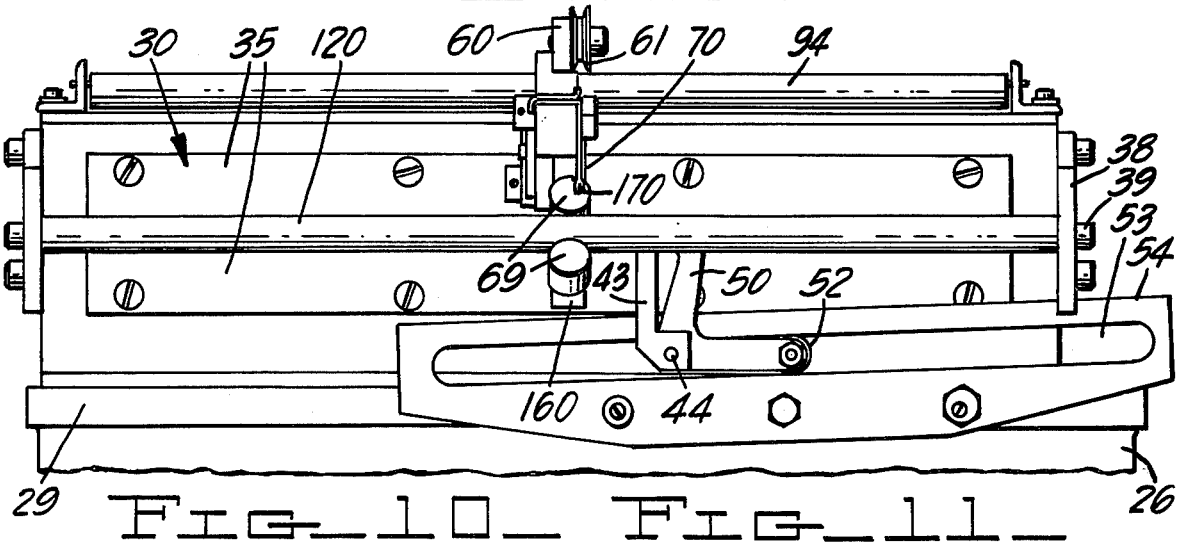
FIG. 9 is a front elevational view showing the inclined cam track used in the adjustment mechanism.

Referring now to FIG. 9, secured to fixed support base 29 is a cam track plate 54 having a cam track 53 which is inclined upwardly from left to right. Riding in cam track 53 is a cam-follower roller 52 which is connected to and carried by one end of a bell crank 50. As seen best in FIGS. 10–12, bell crank 50 is pivoted about a pivot stud 44 located at the lower end of an L-shaped mounting bracket 43, the upper end of which is secured to slide bracket 40.

Figure 13:
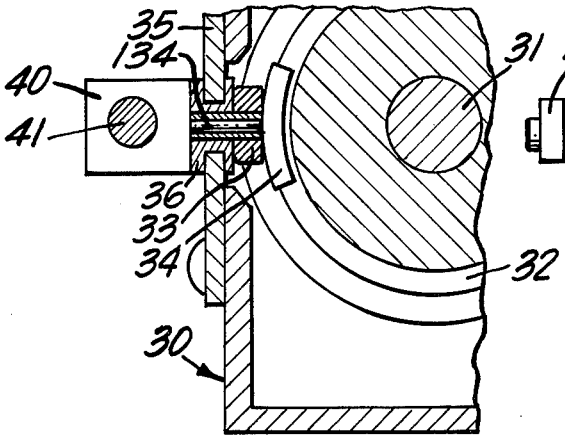
FIG. 13 is a detailed view showing the traverse cam, cam shoe, cam roller, guide piece, and slide bracket secured to the guide piece for travel back and forth relative to the bobbin.

As seen best in FIG. 13, slide bracket 40 is secured to a stud 134 which is integral with and projects laterally from a cam shoe 34, which rides in the cam track of the traverse cam 32. Traverse cam 32 is mounted on traverse cam shaft 31 which is driven by the main drive assembly. Mounted on stud 134 is a cam roller 33 and a guide piece 36 which rides in a guide plate 35.

It will be seen that when the traverse cam shaft 31 is driven by the drive mechanism, the cam shoe 34, cam roller 33, guide piece 36 and slide bracket 40 are carried back and forth in a reciprocating manner.

When slide bracket 40 is carried back and forth in a reciprocating manner, as just described, the bell crank mounting bracket 43 is also carried back and forth, and, since the bell crank 50 is fixed pivotally to mounting bracket 43 at pivot point 44, the bell crank 50 is also carried back and forth.

Supported for sliding movement in slide bracket 40 is an adjustment rod 41 which is pivotally connected at 51 to the upper end of bell crank 50. Thus, as bell crank 50 is carried back and forth, as described above, adjustment rod 41 is carried along with it. Secured to and carried by adjustment rod 41 is a bracket 60 on which a guide beak 70 is mounted. This will be discussed in more detail later in connection with the description of FIGS. 7 and 8. At this time, it will merely be pointed out that the yarn guide beak is secured to bracket 60 which is secured to adjustment rod 41 as by a collar 45, the position of which on rod 41 is adjustable as by a set screw 46.

Figure 10:
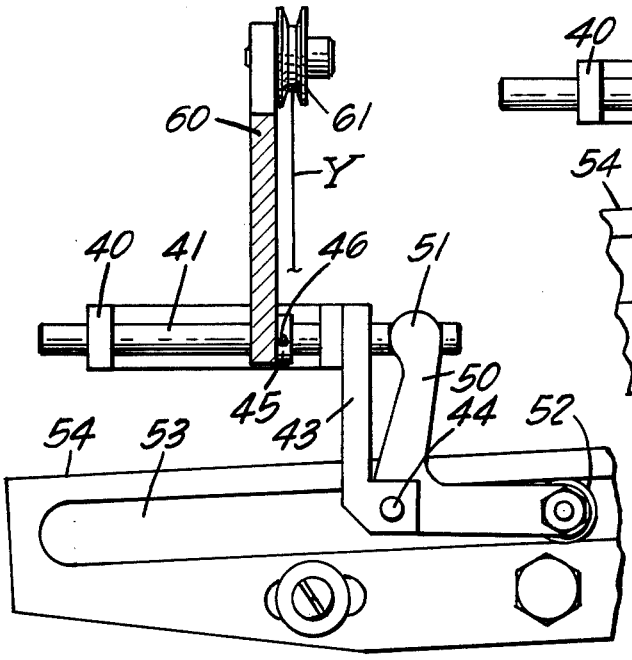
FIG. 10 is a detailed view showing the adjustment mechanism, including the cam track, bell crank, slidable adjustment rod, slide bracket, and holder for the yarn guide beak when the cam follower is in an intermediate position in its movement along the cam track.

In FIG. 10, the adjustment mechanism is shown in the condition it assumes when the traverse mechanism is approximately at the center of its travel.

Figure 11:
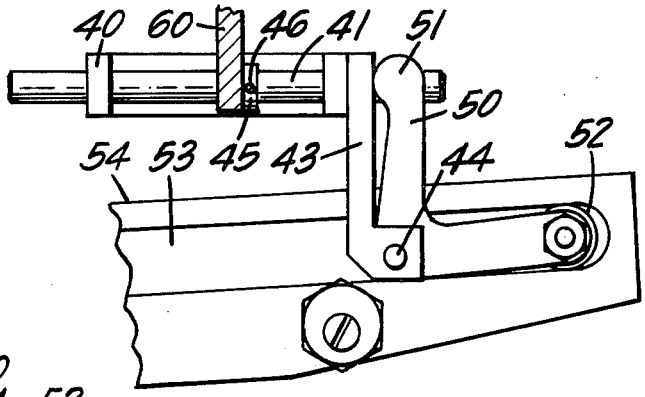
FIG. 11 is a detailed view generally similar to FIG. 10 but showing the adjustment mechanism when the cam follower is at the rightmost end of the cam track.

FIG. 11 illustrates the condition of the adjustment mechanism when the traverse mechanism has reached the right end of its travel. It will be seen that at the right-end limit of its travel, the cam roller 52 has reached its most elevated position, i.e., the upper end of the upwardly inclined cam track 53. As a result, bell crank 50 has moved pivotally in a counterclockwise direction about pivot point 44 and has moved adjustment rod 41 to the left of its leftmost position. This may be seen by comparing the position of bracket 60 in FIG. 11 with its position in FIG. 10. In other words, as slide bracket 40 is carried by the traverse mechanism toward the right end of the bobbin, the bell crank 50 continuously moves adjustment rod 41 to the left, thereby slowing down the rate at which the guide beak 70 is moved to the right relative to the traverse mechanism.

Figure 12:
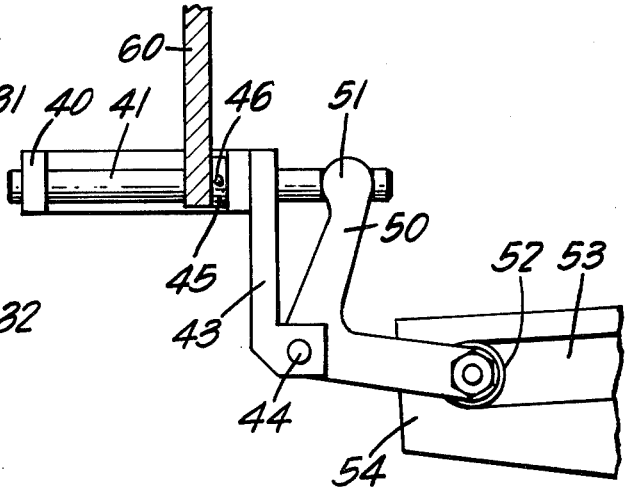
FIG. 12 is a detailed view generally similar to FIGS. 10 and 11 but showing the mechanism when the cam follower is at the leftmost end of the cam track.

In FIG. 12, the traverse mechanism and adjustment mechanism have reached the left end of their travel. As cam-follower roller 52 moved down the downwardly-inclined cam track 53, bell crank moved continuously in a clockwise direction about pivot point 44, thereby pulling adjustment rod 41 continuously to the right relative to slide bracket 40. Thus, in FIG. 12, the cam-follower roller 52 has reached its leftmost limit position, and the adjustment rod 41 has reached its rightmost position. Stated in other words, as the slide bracket 40 is carried to the left by the traverse mechanism, bell crank 50 continuously pulls adjustment rod 41 to the right, thereby slowing down the rate of travel of bracket 60 and guide beak 70 relative to the traverse mechanism.

Figure 7:
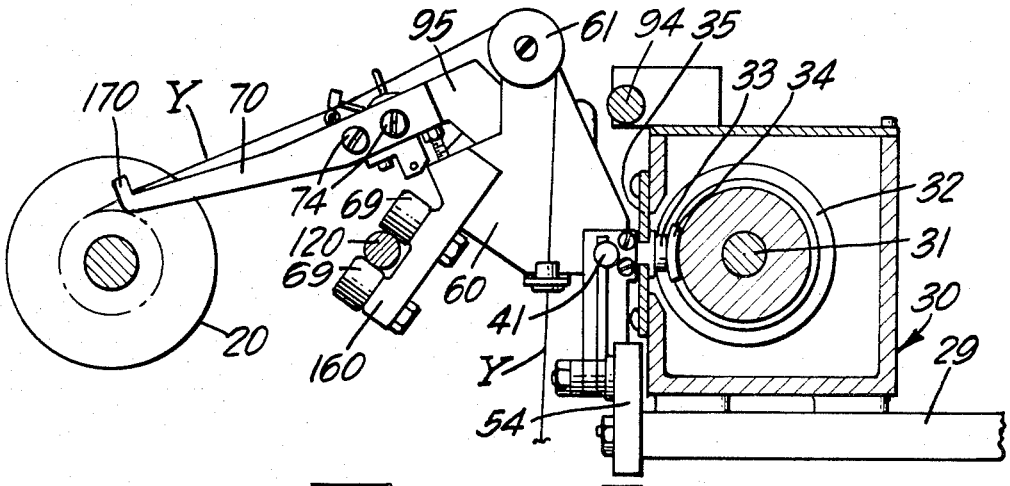
FIG. 7 is a view looking in the direction of the arrow at point 7 of FIG. 6.
Figure 8:
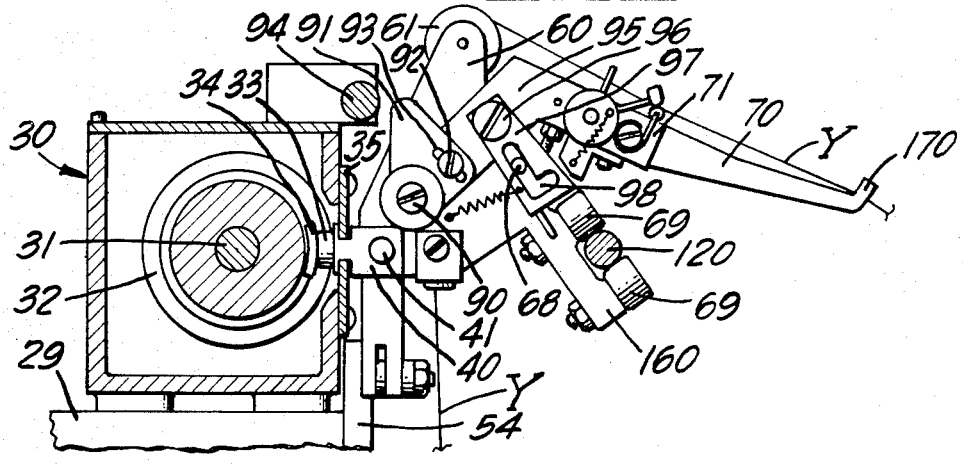
FIG. 8 is a view looking in the direction of the arrow at point 8 of FIG. 6.

Reference is now made to FIGS. 7 and 8 which show how yarn guide beak 70 is mounted on bracket 60 which is mounted on adjustment rod 41. Bracket 60 is a generally triangular bracket having an extension 160 on which a pair of rollers 69 are mounted. Located between rollers 69 is an anti-rotation rod 120, the ends of which are mounted in frame side plates 38, as by screws 39, as seen in FIG. 4.

Figure 6:
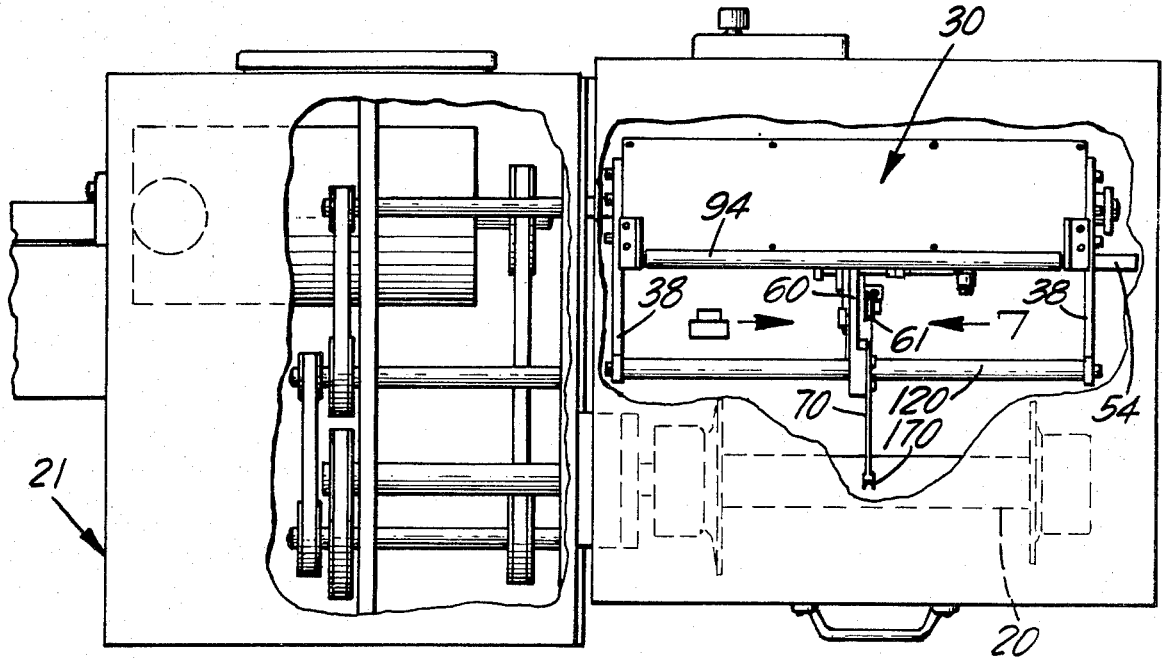
FIG. 6 is a top plan view of the machine of FIG. 1.

Bracket 60 is mounted on and supported by adjustment rod 41 for movement therewith in the axial direction of the bobbin. Mounted at the apex of bracket 60 is a yarn guide roller 61 over which the group of eight yarn ends pass on their way to the channelled front end 170 of yarn guide beak 70, as illustrated in FIG. 6.

Mounted in bracket 60 is a shoulder screw 90 on which are mounted a full-bobbin stop plate 91 and a holder plate 95 for the yarn guide beak 70. The position of the stop plate 91 is adjustable, as by screw 92 in slot 93. It will be seen that as the end 170 of yarn guide beak 70 rises as the yarn builds up on the bobbin, the apex of the stop plate 91 will come into engagement with stop rod 94 and this will be effective, as by electrical means, to shut off the drive to the bobbin.

The yarn guide beak 70 is mounted adjustably, as by screws 74, to the beak holder plate 95 which is an angle plate, as seen best in FIG. 8. Mounted in plate 95 is a pivot stud 96 on which is pivotally mounted a spring-biased lock plate 97 having therein an L-shaped slot 98. A stud 68, mounted in bracket 60, is ordinarily positioned within the longer leg of slot 98. When, during bobbin changes, the yarn guide beak 70 is manually raised to an elevated position, beak holder 95 pivots counterclockwise on shoulder screw 90, as viewed in FIG. 8, and stud 68 slides down the long leg of slot 98 and enters the short leg. This locks the spring-biased plate 97 and prevents the guide beak 70 from falling down during bobbin change.

It should also be pointed out that the yarn guide beak extends all the way to the package. This feature is essential to the operation of the winder since open end winding is being performed. If the beak did not come all the way to the package, the yarn would lag the traverse and the build up on the package would be unacceptable for future use.

I claim:

1. A high speed winder for winding multiple yarn ends onto a flanged bobbin, said winder comprising:

(a) a frame;

(b) bobbin receiving means to hold the bobbin in position for rotation to receive multiple yarn ends thereon;

(c) traversing means including a yarn guide roll and a yarn guide beak mounted adjacent the bobbin when it is held by said receiving means, said yarn guide beak being elongated so that the end adjacent the bobbin is in contact with the yarn package;

(d) driving means connected to said bobbin receiving means and to said traversing means to effect operation thereof; and (e) yarn guiding means receiving the multiple yarn ends from a source and directing the multiple yarn ends to said yarn guide roll on said traversing means, said yarn guiding means being spaced from said yarn guide roll a distance such that the enclosed lash angle of the multiple yarn ends between said guiding means and said guide roll is not more than 20° during a full sweep of said traversing means between its extreme positions along the bobbin.

2. A high speed winder as defined in claim 1 wherein means is provided to adjust the length of travel of said traversing mechanism.

3. A high speed winder as defined in claim 1 wherein said yarn guide means comprises Godet rolls to separate and adjust tension in the multiple yarn ends.

* * * * *